US005871387A

United States Patent [19]

Straus

[11] Patent Number: 5,871,387

[45] **Date of Patent: *Feb. 16, 1999**

[54] TOY FOR REPEATED ADJUSTABLE MOUNTING

[76] Inventor: Jay Bradley Straus, 3350 Judith Dr., Bellmore, N.Y. 11710

[ * ] Notice: This patent issued on a continued prosecution application filed under 37 CFR 1.53(d), and is subject to the twenty year patent term provisions of 35 U.S.C. 154(a)(2).

[21] Appl. No.: 968,926

[22] Filed: Nov. 5, 1997

Related U.S. Application Data

[63] Continuation of Ser. No. 801,250, Feb. 19, 1997, which is a continuation of Ser. No. 585,001, Jan. 11, 1996, which is a continuation of Ser. No. 243,305, May 16, 1994, abandoned.

[51] Int. Cl.[6] ..... G09F 7/12; A47G 1/17

[52] U.S. Cl. ..... 446/491; 446/901; 40/594; 248/205.3; 248/467; 428/42.1; 428/317.1

[58] Field of Search ..... 446/490, 901; 40/594; 249/205.3, 467; 425/40, 42.1, 317.1, 317.3

[56] References Cited

U.S. PATENT DOCUMENTS

| | | | |
|---|---|---|---|
| 3,165,283 | 1/1965 | Borisof | 248/467 |
| 3,777,392 | 12/1973 | Span et al. | 446/78 |
| 4,266,747 | 5/1981 | Souder, Jr. et al. | 248/280.1 |
| 4,525,943 | 7/1985 | Iwata | 40/594 |
| 4,543,278 | 9/1985 | Ackerman | 446/901 X |
| 4,837,953 | 6/1989 | Tannenbaum | 40/124 |
| 4,978,301 | 12/1990 | Dodge | 434/96 |
| 4,979,924 | 12/1990 | Manger | 446/100 |
| 5,195,917 | 3/1993 | Russell et al. | 446/97 |

*Primary Examiner*—Robert A. Hafer
*Assistant Examiner*—Laura Fossum

[57] ABSTRACT

A toy which can be manually, easily, and repeatedly mounted on a wide range of vertical surfaces and remain fixed in place until its position is adjusted by removal and replacement. The toy can be of three dimensional extent and is supported by a unique fastening arrangement comprising a reusable, removable, adhesive putty used in conjunction with a retaining member.

4 Claims, 2 Drawing Sheets

TOY FOR REPEATED ADJUSTABLE MOUNTING

This application is a continuation of Ser. No. 801,250 filed Feb. 19, 1997, which is a continuation of Ser. No. 585,001, filed Jan. 11, 1996, which is a continuation of application Ser. No. 08/243,305, filed May 16, 1994, now abandoned.

BACKGROUND OF THE INVENTION

1. Field of the Invention

This invention relates generally to a toy which can be manually and repeatedly mounted on a wide range of substantially vertical surfaces and remain in place until its position is adjusted by removal and replacement.

2. Prior Art

A great variety of toys are out on the market today. Among these there are model type toys and figures, along with accompanying sets of accessory environments in which they can be placed relatively precisely. Precise placement of toys enhance their role in a child's imagination of different situations and circumstances. For example, a toy vehicle designed for use with an action figure would preferably include a seat in which the figure can be accurately fitted. It would be less than ideal if the figure could not be relatively precisely placed within the vehicle, as it would significantly diminish the sense of realism. Clearly such precise placement plays an important role in a wide array of different toys, ranging from colorform type toys, to construction sets.

One category of toys encompasses those toys which involve the inclusion of a substance or apparatus that allows for repeated attachment and removal of their composite parts. In particular, the use of "Velcro" is fairly common (Velcro is a trademark of Velcro USA). For example, Dodge discloses in U.S. Pat. No. 4,978,301 an educational construction set whose pieces consist of rigid planar materials with attached strips of Velcro. This allows for the joining and parting of the corresponding pieces. Manger details in U.S. Pat. No. 4,979,924 a stuffed animal which uses Velcro attached to external accessories to allow for readily altering the animal's appearance. Russell et al. disclose in U.S. Pat. No. 5,195,917 a tear-apart stress relief doll which has body parts attached to the main torso via Velcro. This allows for the doll to be disassembled easily and quickly.

In addition, in this category of toys there are a few involving a vertical surface. This includes toys designed for climbing down such a surface when thrown against it, and toys such as indoor basketball hoops which attach to walls via suction cups.

OBJECTS OF THE INVENTION

It is an object of this invention to provide a toy which can be manually, easily, and repeatedly, adjustably mounted on a wide range of substantially vertical surfaces. This greatly increases available play space, and reduces clutter, as toys can be arranged on the walls and furniture of a room, as a opposed to the floor.

It is another object of this invention to provide a toy which can remain fixed in place for a reasonable period of time once mounted on a substantially vertical surface.

It is another object of this invention to provide a toy whose mounted position can be immediately adjusted.

It is another object of this invention to provide for a toy which can be arranged in a continuum of positions on a wide range of surfaces which are not specially prepared for its use.

It is another object of this invention to provide a toy which can be of size and weight in a range typically common to other toys and can extend a reasonable amount from the vertical surface.

It is another object of this invention to provide for a toy which can be used in conjunction with other toys, including toys of a similar nature, so that the combination can allow for more realistic, varied, involved, and enjoyable play by children. This includes the use of several of the toys in a set with a common theme, and the use of several of the toys to create varied and interesting scenes.

Other and further objectives of the invention will become apparent upon further study of the accompanying figures, the text of this specification, and the accompanying claims.

BRIEF DESCRIPTION OF THE DRAWINGS

FIG. 3A shows a perspective view of one embodiment of the fastening complex using a projection comprising a rod like member.

FIG. 3B shows a side view of one embodiment of the fastening complex using a projection shaped like a baffle, comprising a series of highly varying shapes.

FIG. 3C shows a side view of one embodiment of the fastening complex using a projection which forms a cavity.

FIG. 4A shows an embodiment of the invention comprising a plurality of toys with a rocket and space theme.

FIG. 4B shows an embodiment of the invention comprising a plurality of toys with an emergency crew theme.

DETAILED DESCRIPTION OF THE PREFERRED EMBODIMENTS

Figure 1:
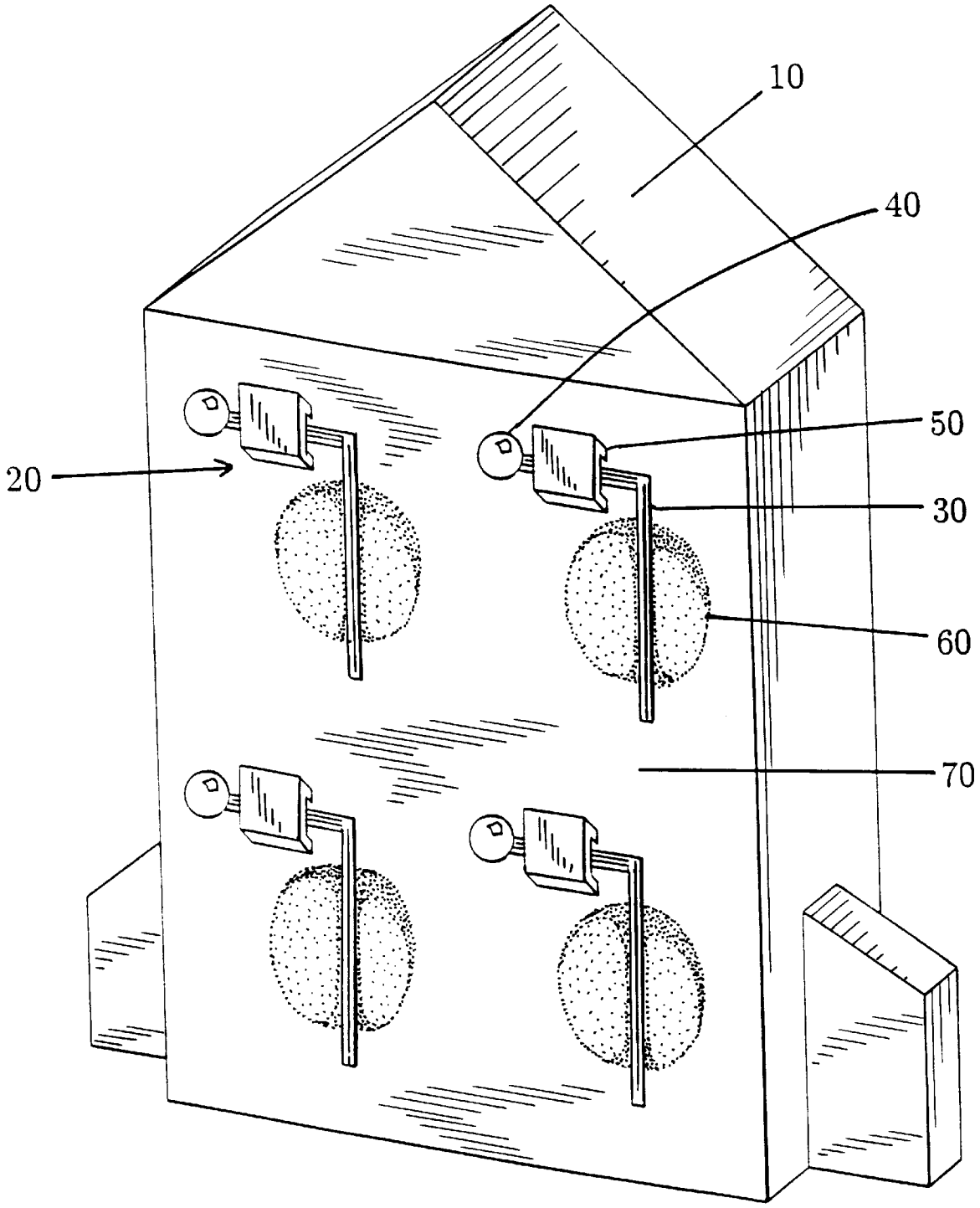
FIG. 1 shows a perspective view of the back of a sample toy as described herein, specifically a model rocket. It especially illustrates a unique fastening device involving a reusable, removable adhesive putty.
Figure 2:
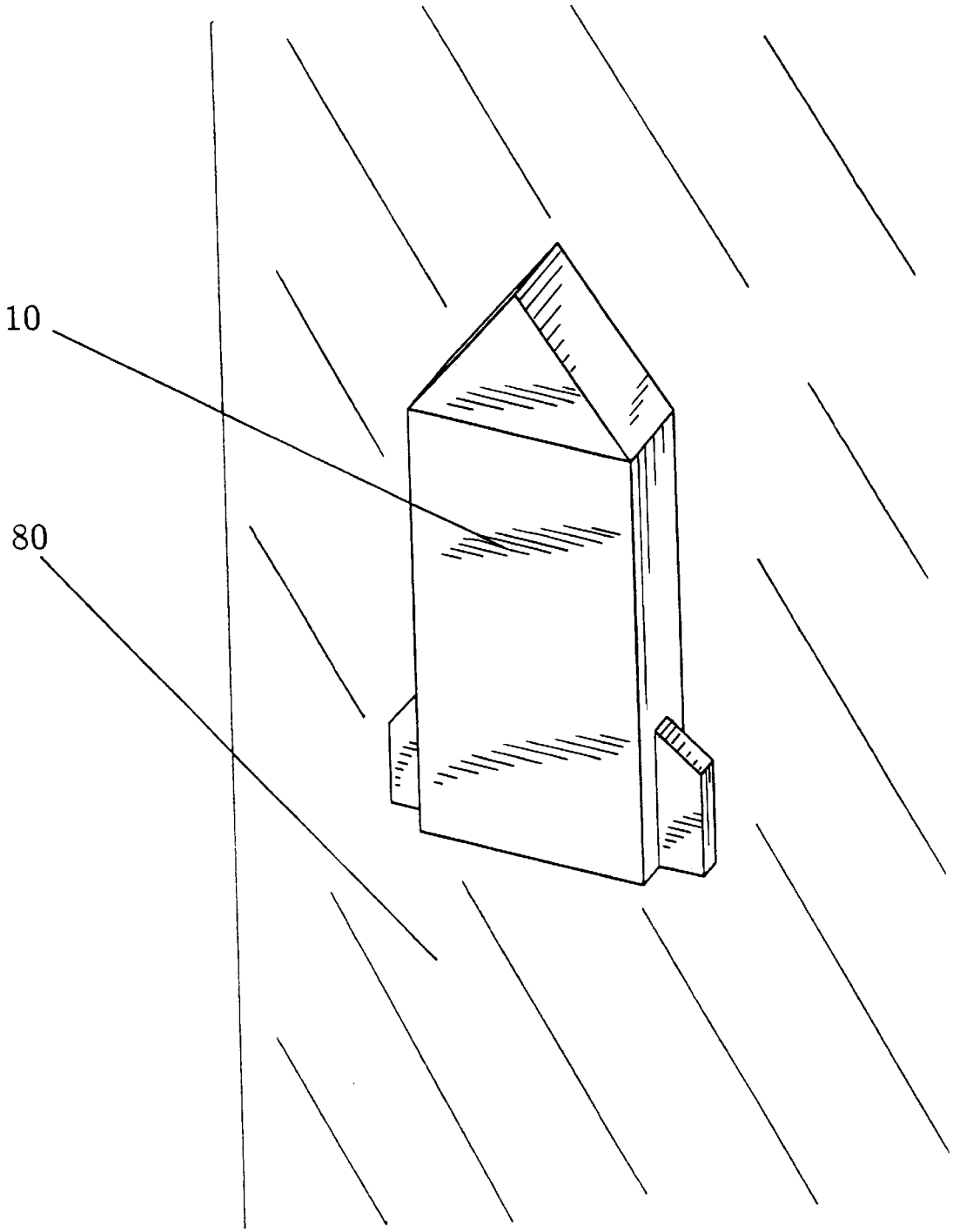
FIG. 2 shows a perspective view of the model rocket mounted on a vertical surface.

One preferred embodiment, shown in FIG. 1, is a model rocket 10. This rocket 10 can be adjustably mounted on a wide variety of surfaces, giving the illusion of flight. It can also be used in conjunction with other, similar, toys to create more complex scenes. The rocket can be adjustably mounted on such a wide range of vertical surfaces through the use of at least one fastening complex 20. In the rocket shown, four such fastening complexes are present. The constituent parts of the fastening complex which is depicted include a retaining member 30 with is held on the rocket via the protrusion 50. Items 30 and 50 are constructed of substantially rigid material. The protrusion allows for some rotational motion of the retaining member 30, typically in a direction directly away or towards the surface. The retaining member 30 also has an extension 40 which prevents it from sliding through protrusion 50 and falling off the rocket. The retaining member acts to engage and retain a reusable, removable adhesive putty 60. A putty of this kind is commerically available from a number of sources. One source is the putty marketed under the brand name "Fun-Tak" by the Dap corporation. Another source is the putty marketed under the name "Stik-Tak" by the Devcon Corporation. Another possible source is marketed under the name "Handi-Tak" by the Super Glue Corporation. The putty adheres to the rocket 10 via the back panel 70 of the rocket. The putty 60 can then also engage a substantially vertical surface 80 as shown in FIG. 2.

The fastening complex 20 merits a close examination. It is an intent of the toy to allow for immediate mounting, immediate dismounting, and then remounting in a different position on a vertical surface. Such an operation would be substantially impeded if the adhesive putty 60 were to remain attached to the vertical surface 80 when the toy was removed. It would also be impeded even if just a portion of the putty were to remain; such a remaining portion would diminish the sense of realism associated with the toy and also the putty on the rocket would provide less support as portions of it are removed. Therefore means are necessary to maintain the putty fixed to the toy, while at the same time allowing for it to make contact with the vertical surface. Such means which can function successfully in all required aspects are not immediately obvious without further examination.

As an example of such a technique which requires examination, the putty cannot be simply glued into place. If the putty were glued, then when the toy is moved the putty could separate into different pieces with the portion of the putty close to the toy remaining on the toy, while the portion attached to the vertical surface remains on the surface. In addition, it is desirable that the putty be able to be removed from the toy. This is because it is common for children to drop toys, as well as store them, in areas where the putty can pick up dirt. While some dirt can be removed by hand, it is often simpler to simply remove the putty and remold it so a fresh surface is exposed. Over time, the putty itself can also be replaced.

As another example of a technique which requires examination, a fine mesh which covers the putty can be considered. This is less than ideal in practice, because during repeated usage the putty begins to work itself through the fine mesh in small pieces. This makes it more difficult for it to remain on the toy. It is also difficult to remove the putty from the mesh as it gets very closely entangled in it; this impedes remolding the putty to expose a fresh surface and removing the putty for replacement purposes.

The use of the retaining member is an excellent solution to the problem posed here. There are three principles which may be involved in its successful functioning which are now discussed. The first principle involves surface area. When the retaining member 30 is pushed down into the putty 60, it does not need to be pushed so far down that it becomes fully embedded inside, and covered by, the putty. Therefore it can form a type of channel, drawing the putty 60 away from the vertical surface 80 in that area. This then has the effect of reducing the surface area of the putty 60 which is contact with the vertical surface 80; the adhesive force between putty and vertical surface is correspondingly diminished. The surface area of the putty in contact with the back panel 70, however, is unaffected. The net effect is then to help the putty be more securely attached to the rocket 10 than to the surface 80. This helps it remain in place on the rocket when it is moved. In fact, one can use this principle of surface area in a slightly different way to construct a version of the present invention where the retaining member is absent. One would create a depression, cavity, structure or projection in the back panel of the toy which the putty can engage. Presumably, when compared to the surface area available for use on the vertical surface, this structure would provide for greater surface area on the toy for the putty to make contact with. This would allow for more secure attachment of the putty to the toy. It should be kept in mind, however, that the structure could be shaped in such a way as to effectively reproduce the presence of a retaining member. FIG. 3B shows a projection 100 with a series of highly varying shapes, 101–103, which engage the putty. FIG. 3C shows a projection 110 which effectively forms a cavity to engage the putty.

The second principle involved is the role of the retaining member in providing a type of "tie-breaker" force. When the rocket 10 is removed from the vertical surface 80, the putty 60 is subjected to a force acting to keep it on this surface (because it has adhered thereto) and also a force acting to keep it on the back panel 70 (because it has also adhered to the back panel). The two forces may be roughly equal in size. The retaining member 30 can then act to provide a force tipping the balance in favor of remaining on the back panel 70.

The third principle discussed here makes contact with some elements from the first two, but also recognizes the role of the natural integrity of the putty 60. During repeated usage the retaining member may eventually become embedded inside the putty and the channel discussed previously may disappear. However, if this occurs the member 30 will typically be embedded in only a shallow fashion. Thus, when the rocket 10 is moved and the member provides a type of tie-breaker force, the bulk of the putty is still between the member 30 and the back panel 70. A much smaller percentage of the putty is between the member 30 and the vertical surface 80. As a result of the natural integrity of the putty, it has a tendency to remain as a single unit when not broken into very small pieces, and therefore the smaller amount closer to the surface remains both continuous and integral with the larger amount closer to the back panel.

Several other issues need to also be addressed. Among these is the fact that preference should be given to material selected for the construction of the back panel 70 to which the putty 60 adheres well. This provides for greater support of the rocket 10. Also, a separate catch to keep the retaining member in place on the putty is not neccessary; the putty itself performs that function.

It also should be noted that the putty detailed in here can provide sufficient support to a reasonable range of possible sizes and weights of toys. This is not a foregone conclusion with all possible adhesives. If a toy extends a considerable degree from the vertical surface then it can exert great leverage on the adhesive substance; the further from the surface, the greater the leverage. This large torque can act to dislodge the toy from the surface. As an example, an experiment was carried out using the reusable plastic adhesive substance found commonly in modern lint-removers. This substance is very sticky when dry and can be made wet in order to remove dirt. Experimentation was carried out in which large amounts of this substance were attached to a model toy to attempt to secure it to a vertical surface. Regardless of the amount of the substance used, it was found that the extension of the toy out from the vertical surface provided sufficient torque to peel away the sticky substance and dislodge the toy. This is not the case for the fastening device 20 described here; the toy can remain fixed in place for a reasonable period of time, often indefinitely. Also, the putty 60 described herein is non-toxic, making it suitable for use by children.

It is important to realize that the particular means shown in the figures of securing the retaining member 30 to the rocket 10 is not of crucial importance. While a protrusion 50 and an extension 40 are shown, many other arrangements are possible; it must be kept in mind, however, that it is desirable to minimize any interference with the putty adhering to the surface 80. In particular, a simple hinge attaching the member to the back panel 70 could be effective and still allow for a desired rotational motion that facilitates removing and inserting the putty. Such motion, however, is not absoutely necessary. A member which is fixed in place could still function effectively. It would be possible to mold the appropriate portion of the putty by hand to fit underneath the fixed member, and it may be less expensive to manufacture a toy of this design.

There are numerous other possible embodiments of the invention besides those already discussed. In particular, it is of great utility to be able to use a number of the toys in conjunction with each other, especially in sets with a common theme. Rather than a single mountable rocket one could have several mountable rockets, a mountable model of a planet, and a mountable space station. Mountable action figures are also possible. Indeed, the same range of models of real and fictional items and characters commonly present in many different toys is applicable for use here. There is no restriction that only model rockets are suitable; the rocket discussed herein is only a conventient example. Model buildings, roads, cars, and people can be mounted around a room to construct a model village. By allowing the vertical surfaces of a room to be used to mount toys the available play space is substantially increased. This can help reduce the clutter of toys strewn about the floor. The child can then imagine that he is actually inside such a three-dimensional village. Or a single house can be constructed with a visible interior. Walls, floors, furniture and other accoutrements can be mounted in position. Also, backdrops with appropriate backgrounds and scenery can be mounted. Perhaps models can even be mounted on top of them. In addition, it is possible to use non-mountable toys in a variety of ways with the present, mountable toys.

Another possible embodiment of the invention consists of a combination of a toy with a three-dimensional extension from the vertical surface with a basically two dimensional pictorial continuation attached. For example, one might have a two dimensional pictorial representation of half of a plane and one wing, with the other wing given three dimensional substance and extending outward from the picture and surface. This gives the visual impression that the plane actually extends into the area within the boundary of the vertical surface.

Thus it can be seen that the present invention details a new type of toy which can allow for extensive and enjoyable play by children. Two typical embodiments are shown in FIGS. 4A and 4B. FIG. 4A shows a set of rockets and spacecraft mounted on a wall to form a set of toys with a space theme. FIG. 4B shows a set of toys mounted on a wall to allow for play with a hospital or emergency crew theme. There are numerous other possible embodiments available, including potential uses for educational purposes as well. For example, items such as letter blocks or numbers clearly lend themselves quite well to the type of presentation available with the device detailed herein.

Note that any discussion of any kind relevant to one modification or embodiment of the invention may also be applied to any other modification or embodiment of the invention when it is appropriate to do so. Other and further modifications and advantages of the invention will become apparent upon further study of the enclosed figures, the text of this specification, and the accompanying claims. Therefore the scope of the invention should be determined by the accompanying claims, rather than just by the examples that have been given.

What is claimed is:

1. A toy for releasably attaching to vertical surfaces, comprising:

a plurality of models simulating real or fanciful machines or characters, said models having at least one substantially planar back panel, and at least one side surface, extending from said back panel to define a three-dimensional model, said at least one side surface designed such that said models can be easily grasped by a child;

each of said plurality of models including at least one reusable, removable, deformable, adhesive putty on said back panel, said putty having adhesive qualities sufficiently strong so as to support said models for an extended period of time on an unprepared vertical surface, by supporting the weight of said models, said adhesive qualities further being sufficiently weak so as to allow a child to remove said models from said unprepared vertical surface manually, easily, and immediately without any special tools, and wherein said putty is designed to be easily removed from said back panel;

each of said plurality of models further including at least one elongated retaining projection, and a means for attaching said projection to said back panel, said projection engaging and retaining said putty on said back panel of each of said plurality of models, and wherein said at least one elongated retaining projection is designed to allow said putty to be easily removed from and replaced on said back panel; and wherein said plurality of models, including their respective putty, retaining projections, and said means for attaching said projection to said back panel, are designed to be, without any special tools, manually, easily, and immediately, repeatedly positioned, repositioned, and maintained on said unprepared vertical surface, including walls and common household furniture, without any intermediary surface.

2. The toy as recited in claim 1, wherein each of said plurality of models further include a plurality of said adhesive putties, a plurality of said elongated retaining projections, and a plurality of said means for attaching said projection to said back panel.

3. The toy as recited in claim 2, wherein said means for attaching said projection to said back panel allow rotational movement of said elongated retaining projections.

4. The toy as recited in claim 1, wherein said means for attaching said projection to said back panel allow rotational movement of said elongated retaining projections.

* * * * *